US010773370B1

(12) United States Patent
Warzecha

(10) Patent No.: US 10,773,370 B1
(45) Date of Patent: Sep. 15, 2020

(54) SANITARY KNIFE

(71) Applicant: Ronald R. Warzecha, Saint Cloud, MN (US)

(72) Inventor: Ronald R. Warzecha, Saint Cloud, MN (US)

( * ) Notice: Subject to any disclaimer, the term of this patent is extended or adjusted under 35 U.S.C. 154(b) by 0 days.

(21) Appl. No.: 15/853,532

(22) Filed: Dec. 22, 2017

Related U.S. Application Data

(60) Provisional application No. 62/441,512, filed on Jan. 2, 2017.

(51) Int. Cl.
*B25G 1/10* (2006.01)
*B26B 3/00* (2006.01)

(52) U.S. Cl.
CPC ..... *B25G 1/102* (2013.01); *B26B 3/00* (2013.01)

(58) Field of Classification Search
CPC ..... B25G 1/102; B26B 3/00; A47J 17/04
See application file for complete search history.

(56) References Cited

U.S. PATENT DOCUMENTS 479,102 A * 7/1892 Willbrandt ..... B26B 3/00 30/343
D126,717 S 4/1941 Futterman
D133,417 S 8/1942 Ng
D155,386 S 1/1948 Bugg
D166,394 S 4/1952 Herold
D172,595 S 7/1954 Halvorson
D179,216 S 11/1956 Repscher et al.
2,775,034 A 12/1956 Bulecki
D180,571 S 7/1957 Wild
2,873,523 A 2/1959 Garland et al.
3,100,935 A 8/1963 Leafe
3,249,999 A 5/1966 Ward
D214,121 S 5/1969 Cheslak
3,751,806 A 8/1973 Patrick
D229,391 S 11/1973 Nelms
D230,007 S 1/1974 Cramer et al.
D233,232 S 10/1974 Koppe
D235,414 S 6/1975 Miller
(Continued)

OTHER PUBLICATIONS

"Fish Safely Knife Range", The Safety Knife Company, http://www.safetyknife.net/Products/fish-range, 1 page, downloaded Nov. 22, 2016.

*Primary Examiner* — Kenneth E Peterson
*Assistant Examiner* — Fernando A Ayala
(74) *Attorney, Agent, or Firm* — Albert W. Watkins

(57) ABSTRACT

A food grade safety knife includes a safety knife blade, a handle, and a stepped region adjacent the juncture therebetween. The handle is defined by a pair of spaced apart major surfaces that include an enlarged palm portion; a flared end distal to the enlarged palm portion that anchors the safety knife blade, and a neck region intermediate between. The stepped region has a thickness greater than the enlarged palm portion. The stepped region rises in a plurality of discrete steps from the generally planar major surfaces and generally increases in thickness with increasing distance from the enlarged palm portion to a maximum thickness most nearly adjacent to the safety knife blade. At least one of the plurality of steps within the stepped region is provided with at least three generally linear segments each angularly offset from adjacent ones of the at least three generally linear segments.

17 Claims, 2 Drawing Sheets

(56) References Cited

U.S. PATENT DOCUMENTS

D236,321 S 8/1975 Cromoga
D236,579 S * 9/1975 Morback ..... A61B 17/34 D7/649
D237,354 S 10/1975 Gerson et al.
D256,217 S 8/1980 Korn
D301,680 S 6/1989 Glaze
D305,499 S 6/1990 Walker
D320,150 S 9/1991 Huang
5,046,253 A 9/1991 Ireland
D323,967 S 2/1992 Talbot
D352,440 S 11/1994 Perigny
5,412,871 A 5/1995 Reyburn et al.
D376,091 S 12/1996 Heglin
D377,595 S 1/1997 Wiezenthal
5,737,842 A 4/1998 Freedman
5,890,290 A 4/1999 Davis
6,502,314 B1 * 1/2003 McCatty ..... B25G 1/102 16/430
D470,030 S 2/2003 Swier
D481,609 S 11/2003 Perlmutter et al.
6,675,485 B1 * 1/2004 Shih ..... B26B 1/10 30/321
6,691,416 B2 2/2004 Yu Chen
D508,390 S 8/2005 Trbovich, Jr.
D515,389 S * 2/2006 Hsu ..... D8/83
7,003,884 B2 2/2006 Perlmutter et al.
D525,102 S 7/2006 Gullicks et al.
D525,852 S 8/2006 Pearson et al.
D527,603 S 9/2006 Gullicks et al.
D527,604 S 9/2006 Kempker et al.
7,150,754 B2 * 12/2006 Ziemer ..... A61B 17/3213 606/167
D540,647 S 4/2007 Ireland
D568,709 S 5/2008 Packard et al.
D571,180 S 6/2008 Marshall
D573,436 S 7/2008 Wu
D574,210 S 8/2008 Packard et al.
D575,613 S 8/2008 Jennings
D579,744 S 11/2008 Neiser
D580,729 S 11/2008 Packard et al.
D582,746 S 12/2008 Neiser
D584,935 S 1/2009 Packard et al.
D586,644 S 2/2009 Packard et al.
D589,589 S 3/2009 Mccloudry et al.
D590,687 S 4/2009 Ireland
7,533,595 B2 5/2009 Domenico
D602,324 S 10/2009 Hancock et al.
7,624,507 B2 12/2009 Bergstrand
7,818,885 B2 10/2010 Lafauci et al.
D631,724 S 2/2011 Della Polla
D633,616 S 3/2011 Lafauci et al.
D636,248 S 4/2011 Still
D638,904 S * 5/2011 Freeman ..... D22/118
8,006,390 B2 8/2011 Mueller et al.
D649,001 S 11/2011 Still
D655,995 S 3/2012 Ireland
D655,996 S 3/2012 Ireland
D658,016 S * 4/2012 Grass ..... B26B 29/00 D7/401.2
D660,674 S 5/2012 Still
D660,675 S 5/2012 Gringer et al.
8,171,647 B2 5/2012 Gullicks et al.
D664,417 S 7/2012 Still
D673,440 S 1/2013 Kempker et al.
8,409,231 B2 * 4/2013 Dunn ..... A61B 17/3213 30/329
D684,451 S 6/2013 Jennings et al.
D687,287 S 8/2013 Yu Chen
D692,288 S 10/2013 Locklear
D694,609 S 12/2013 Hicks
8,615,888 B2 * 12/2013 Catalano ..... B25G 1/102 30/151
D707,097 S 6/2014 Kao
D714,611 S 10/2014 Yu Chen
D714,612 S 10/2014 Gropl et al.
D717,627 S 11/2014 Lin
9,968,372 B2 * 5/2018 Chen ..... A61B 17/34
2002/0124418 A1 * 9/2002 Votolato ..... B26B 5/00 30/294
2003/0093100 A1 * 5/2003 Robinson ..... A61B 17/3213 606/167
2003/0131393 A1 * 7/2003 Votolato ..... A41D 13/081 2/16
2006/0016306 A1 1/2006 Conde
2006/0075606 A1 * 4/2006 Lawless ..... B25B 33/00 16/430
2007/0156160 A1 * 7/2007 Petersen ..... A61B 17/3213 606/167
2010/0293796 A1 * 11/2010 Votolato ..... B26B 29/00 30/287

* cited by examiner

SANITARY KNIFE

CROSS REFERENCE TO RELATED APPLICATIONS

The present application claims the benefit of U.S. provisional patent application 62/441,512 filed Jan. 2, 2017 of like title and inventorship, the teachings and entire contents which are incorporated herein by reference.

BACKGROUND OF THE INVENTION

1. Field of the Invention

The present invention pertains generally to handheld cutting tools, and more particularly to a sanitary safety knife optimized for use in a food processing facility.

2. Description of the Related Art

The preparation of foods can require many steps, and many diverse ingredients or source materials. In order for foods to be safe for consumption, each of the steps must be carried out in a sanitary manner, with no contamination introduced in the process step. As a result, and in view of the importance of a safe food supply, food processing facilities have a number of very stringent requirements. One of these is that the tools and equipment used must be food grade, meaning there is no toxic compound that could be transferred into the food, and also that the materials and compositions of the tools and equipment will not become a source of toxic contaminants over time. For example, a porous material such as a foam may collect food or food-sourced liquids in the pores of the foam during use. Owing to the geometry of most foams, an external spraying or washing such as produced by an automatic dish washer will not penetrate sufficiently deeply into the foam to remove the food-based particles and liquids. This means that the foam will retain food components that over time may accumulate and harbor colonies of microbes. As is apparent, these microbial colonies and their by-products may then be released back into the food, creating potentially toxic food contamination. As another example, a plastic that degrades may release toxic monomers or plasticizers during decomposition, rendering the plastic unsafe for food contact.

As may be appreciated then, tools and equipment used in food facilities must be fabricated from compositions that are free of toxic compounds, and they must also be of such a geometry as to be readily and completely cleaned. As a result, there are a particular set of materials that are generally approved for contact with food, and so are identified as being "food grade" or "food safe". Exemplary materials include stainless steel, glass, and some polymers.

In addition to the selection of appropriate materials, and fabricating tools and equipment that are readily cleaned, the tools and equipment will also preferably either be harmless if consumed, or be detectable in the event of unintended contamination. While glass is food safe, glass also easily chips and detection of glass chips present in the food can be extremely difficult. In consideration thereof, for exemplary and non-limiting purposes, the knives and equipment that are operated are preferably fabricated from materials that will readily be detectable by known metal detection techniques. In the event of a mechanical failure or breakage of the tools and equipment, any fragments that could be harmful to a person can be detected before the food leaves the production facility. This is particularly important with knives, since the knives are often relatively thin and hard to facilitate cutting through food, packaging, and other objects. While a thin hard knife will much more efficiently cut through other objects such as food and packaging, the knife is also somewhat more brittle and prone to snapping or fracturing. Yet, by the very design, the broken fragment can pose a serious hazard should a person get the fragment in their mouth or swallow the fragment. The same issues arise with machinery, where the intrinsic strength and durability of metals is desirable, and yet in the event of a mechanical failure could lead to hazardous food contamination.

In addition to being of appropriate composition and geometry to not harbor contaminants and to not release toxic substances, a good tool will also protect the safety of the food processing workers. The benefit to the workers is apparent. However, such precautions not only protect the workers, they also protect consumers. While metal fragments are detectable with appropriate metal detection techniques, possible blood contamination from a worker being cut is far more difficult to detect. Yet, since a knife is designed explicitly to cut other objects, the design of a knife that will not cut a food worker is counter-intuitive.

A number of artisans have designed various cutlery for various purposes, some which provide relevant teachings and examples, and some which provide a measure of the skill in the broader cutlery industry. Exemplary U.S. patents, the teachings which are incorporated herein by reference, include: Des 655,996 by Ireland, entitled "Safety knife"; Des 664,417 by Still, entitled "Cutter"; U.S. Pat. No. 2,775,034 by Bulecki, entitled "Seam opener"; and Des 305,499 by Walker, entitled "Carton Cutter".

The aforementioned Ireland patent Des 655,996 has a number of features exemplary of many of the safety knives used in various industries for purposes such as opening packages of many sorts and geometries. One end of the knife has a relatively larger and straight blade that is well suited to cutting sheet material, thread, and many other diverse materials. At the opposite end, a smaller "C" shaped retractable blade is provided that is well suited for cutting through a tape seal such as may be found on a carton or box, while limiting the depth of the cut to avoid cutting or nicking the contents of the carton or box. Such a knife serves many industries extremely well, offering safe cutting of many diverse objects and materials.

Unfortunately, in the food industry there are several deficiencies that render this otherwise wonderful Ireland safety knife completely unacceptable. As noted herein above, in the food industry the geometry must be such that the knife may be completely cleaned using equipment such as an automatic dishwasher. The extremely sharp transitions, retracting knife, and accessible interior portions or cavities all lead to a knife that will harbor harmful microbes such as bacteria and residues that will not be removed by most cleaning equipment. In addition, a person using the safety knife may not always have clean hands, particularly in the case of a worker who opens packages with wet contents. Once again, this is very common in the food industry. In such instance, the features of the Ireland knife do not provide the desired degree of gripping ability and stability within a person's hand. In other words, the worker's hand will readily slip relative tho the knife. Since the knife is specifically designed to protect the worker from harm this will not likely result in any lasting consequence to the worker, but it will lead to much worker frustration, and can lead to unintentional damage to the packages and package contents.

The geometry of the aforementioned Still patent Des 664,417 overcomes many of the deficiencies of the Ireland safety knife for food industry use, but not all. The simpler curves and apparent unitary construction of the handle provide a cutter that may be cleaned with most automatic dishwashers, when desired. Further, the apparent finger grooves and longitudinal midline depression in the handle each provide somewhat better grasping in some directions than achieved with the Ireland knife. Nevertheless, this geometry is still hard to control and prevent from twisting or rotating about the longitudinal axis during use. Furthermore, the person's hand is significantly removed from the cutter, meaning there is a relatively longer handle between the person's hand and the cutter. In some situations, this makes controlling the knife more difficult, and there are no available options in how to grasp the knife to allow a person to safely grasp the knife closer to the cutter.

While both of the aforementioned U.S. Pat. No. 2,775,034 by Bulecki and Des 305,499 by Walker provide other unitary handles, neither provide any teachings to overcome these deficiencies in the cutlery handles that would allow them to perform well in the food industry.

A number of other handle geometries have also been devised by these same and other artisans. Exemplary U.S. patents and published applications, the teachings which are incorporated herein by reference, include: U.S. Pat. No. 3,751,806 by Patrick, entitled "Tape cutter"; U.S. Pat. No. 5,046,253 by Ireland, entitled "Knives"; U.S. Pat. No. 5,737,842 by Freedman, entitled "Cutting tool"; U.S. Pat. No. 6,691,416 by Yu Chen, entitled "Cutter for vehicle safety belts or the like"; U.S. Pat. No. 7,003,884 by Perlmutter et al, entitled "Cutting tool"; U.S. Pat. No. 7,818,885 by Lafauci et al, entitled "Device for performing surgery"; Des 133,417 by Ng, entitled "Combination Tool"; Des 172,595 by Nalvorson, entitled "Metal-Cutting Tool"; Des 230,007 by Cramer et al, entitled "Tape Cutter"; Des 233,232 by Koppe, entitled "Handle for Hunting Knife"; Des 235,414 by Miller, entitled "Carpet Knife"; Des 237,354 by Gerson et al, entitled "Utility Knife Handle"; Des 301,680 by Galze, entitled "Knife for Cutting Plastic Cable Insulation"; Des 320,150 by Huang, entitled "Stretch film cutter"; Des 323,967 by Talbot, entitled "Safety knife"; Des 481,609 by Perlmutter et al, entitled "Cutting tool"; Des 527,604 by Kempker et al, entitled "Cutter"; Des 573,436 by Wu, entitled "Safety cutter"; Des 574,210 by Packard et al, entitled "Media cutting device"; Des 575,613 by Jennings, entitled "Disposable film cutter"; Des 580,729 by Packard et al, entitled "Media cutting device"; Des 586,644 by Packard et al, entitled "Media cutting device with film wrap over"; Des 589,589 by McCloudry et al, entitled "Fishing tool"; Des 590,687 by Ireland, entitled "Knife"; Des 633,616 by Lafauci et al, entitled "Scalpel"; Des 636,248 by Still, entitled "Knife"; Des 649,001 by Still, entitled "Knife"; Des 655,995 by Ireland, entitled "Safety knife"; Des 673,440 by Kempker et al, entitled "Cutter"; Des 660,674 by Still, entitled "Knife"; Des 660,675 by Gringer et al, entitled "Twin blade head for a knife"; Des 714,612 by Gropl et al, entitled "Safety cutter"; and 2006/0016306 by Conde, entitled "Landscape Utility Knife Assembly". In order for a safety knife to function well in the food industry, not only is the handle geometry and composition critical, but so is the blade geometry. Several artisans have provided exemplary U.S. patents and published applications, the teachings which are incorporated herein by reference, including: U.S. Pat. No. 2,873,523 by Garland et al, entitled "Tile cutting and fusing tool"; U.S. Pat. No. 5,412,871 by Reyburn et al, entitled "Safety stock carton knife"; Des 155,386 by Bugg, entitled "Stitch and Seam Opening Device"; Des 179,216 by Repscher et al, entitled "Cable Cutter Head"; and Des 236,321 by Cromoga, entitled "Skinning Knife".

As noted herein above, while metal particles may be detected using X-rays and other techniques, blood from a cut worker can be far more difficult or impossible to detect. Consequently, safety of the blade design in conjunction with the handle is of paramount importance. In addition to the Ireland patents Des 590,687 and Des 655,996, which each illustrate a retractable "C" shaped blade, others such as Garland et al 2,873,523 and Reyburn et al 5,412,871 noted immediately above also illustrate this type of blade. With small enough diameter of curvature of the cutting portion, and suitable inset or concavity, the blade is inaccessible to human fingers or other body parts. Further, the blade tip most distal to the handle is not a cutting surface. Consequently, a person using such a blade may push to hard along the longitudinal axis of the handle without fear of damaging package contents by this blade distal tip. In distinct contrast thereto, the pointed tips and exposed cutting edges illustrated in Bugg Des 155,386 and Repscher et al Des 179,216 patents would be unacceptable for the food service industry.

Additional U.S. patents of varying relevance, the relevant teachings and contents which are incorporated herein by reference, include: U.S. Pat. No. 3,100,935 by Leafe, entitled "Tool for the ripping of seams and like purposes"; U.S. Pat. No. 3,249,999 by Ward, entitled "Knife for cutting tire cord fabric"; U.S. Pat. No. 5,890,290 by Davis, entitled "Adjustable depth safety cutter"; U.S. Pat. No. 7,533,595 by Domenico, entitled "Lamina cutter"; U.S. Pat. No. 7,624,507 by Bergstrand, entitled "Hand-held cutting device"; U.S. Pat. No. 8,006,390 by Mueller et al, entitled "Media cutting and ribbon curling device"; U.S. Pat. No. 8,171,647 by Gullicks et al, entitled "Cutting device with actuating mechansim"; Des 126,717 by Futterman, entitled "Combined Twine Cutter and Support"; Des 166,394 by Herold, entitled "Cutting Tool"; Des 180,571 by Wild, entitled "Razor Blade Holder"; Des 214,121 by Cheslak, entitled "Soft Wrapping Cutter"; Des 229,391 by Nelms, entitled "Cutting Tool for Plastic and the Like"; Des 256,217 by Korn, entitled "Knife"; Des 352,440 by Perigny, entitled "Ripping knife"; Des 376,091 by Heglin, entitled "T hook bale knife"; Des 377,595 by Wiezenthal, entitled "Cutter"; Des 470,030 by Swier, entitled "Emergency rescue knife for cutting a seat belt"; Des 508,390 by Trbovich, entitled "Strap cutter"; Des 525,102 by Gullicks et al, entitled "Media cutter"; Des 525,852 by Pearson et al, entitled "Media cutting device"; Des 527,603 by Gullicks et al, entitled "Media cutter"; Des 540,647 by Ireland, entitled "Safety knife"; Des 568,709 by Packard et al, entitled "Media cutting device"; Des 571,180 by Marshall, entitled "Safety knife"; Des 579,744 by Neiser, entitled "Shrink wrap opener"; Des 582,746 by Neiser, entitled "Box opener"; Des 584,935 by Packard et al, entitled "Media cutting device"; Des 602,324 by Hancock et al, entitled "Cutting tool"; Des 631,724 by Della Polla, entitled "Bidirectional safety knife"; Des 684,451 by Jennings et al, entitled "Combination bag squeeze and cutting device"; Des 687,287 by Yu Chen, entitled "Cutter"; Des 692,288 by Locklear, entitled "Escape tool"; Des 694,609 by Hicks, entitled "Rescue tool"; Des 707,097 by Kao, entitled "Emergency escape tool for vehicle"; and Des 714,611 by Yu Chen, entitled "Cutter"; Des 717,627 by Lin, entitled "Trimming knife".

As may be apparent, in spite of the enormous advancements and substantial research and development that has been conducted, there still remains a need for an improved safety knife better suited for the food industry.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a food grade safety knife. The safety knife has a safety knife blade, a handle, and a stepped region. The handle is defined by a pair of spaced apart, generally parallel, and generally planar major surfaces, and has an enlarged palm portion distal to the safety knife blade. A flared end is distal to the enlarged palm portion. The safety knife blade extends from the handle flared end in a direction distal to the enlarged palm portion. A neck region is intermediate between and relatively narrower than the enlarged palm portion and the flared end. A stepped region is provided within the flared end and immediately adjacent to the safety knife blade. The stepped region has a thickness greater than the enlarged palm portion and thereby rises in a plurality of discrete steps from the generally planar major surfaces.

In a second manifestation, the invention is a food grade safety knife. The knife includes a safety knife blade having a rounded tip terminating the safety knife blade at a first end; an anchoring region terminating the safety knife blade at a second end distal to the first end; and a cutting edge intermediate between the rounded tip and the anchoring region. A handle is defined by a pair of spaced apart, generally parallel, and generally planar major surfaces having: an enlarged palm portion distal to the safety knife blade; a flared end distal to the enlarged palm portion, the safety knife blade anchoring region captured within the handle flared end and the safety knife blade extending from the handle flared end in a direction distal to the enlarged palm portion; and a neck region intermediate between and relatively narrower than the enlarged palm portion and the flared end. A stepped region is provided within the flared end and immediately adjacent to the safety knife blade, the stepped region of thickness greater than the enlarged palm portion and thereby rising in a plurality of discrete steps from the generally planar major surfaces and generally increasing in thickness with increasing distance from the enlarged palm portion to a maximum thickness most nearly adjacent to the safety knife blade. At least one of the plurality of steps within the stepped region is provided with at least three generally linear segments each angularly offset from adjacent ones of the at least three generally linear segments.

In a third manifestation, the invention is a method of avoiding cross contamination in a food service operation. In accord with the method, a first color is designated as indicative of contact with raw food. A second color is denoted as indicative of contact with ready-to-eat food. A first food grade safety knife is provided having a first colored handle. A second food grade safety knife is provided having a second colored handle. Operations of the first food grade safety knife are restricted to a raw processing portion of the food service operation. Operations of the second food grade safety knife are limited to a ready-to-eat food processing portion of the food service operation.

OBJECTS OF THE INVENTION

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a high quality, easily used and manipulated safety knife satisfactory for use within the food industry. A second object of the invention is to provide such a knife that may be readily manufactured for a reasonable cost. Another object of the present invention is the provision of a safety knife which will have gentle geometric transitions and unitary construction of the handle that may be reliably and completely cleaned using common industry equipment such as an automatic dishwasher. A further object of the invention is to also provide a desired degree of gripping ability and stability within a person's hand. Yet another object of the present invention is to provide a safety knife handle geometry that allows a person to place their hand immediately adjacent to the cutter when desired, to improve the control of the safety knife. An additional object of the invention is the provision of a safety knife having a blade with small enough diameter of curvature of the cutting portion, and suitable inset or concavity, to be inaccessible to human fingers. An even further object of the invention is the provision of a safety knife having a blade tip most distal to the handle that is not a cutting surface, and which may be pushed along the longitudinal axis of the handle toward package contents without fear of damaging package contents by this blade distal tip.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred embodiment, the present invention provides a safety knife handle 10, a safety knife blade 20, and a combination handle 10 and blade 20 that together form a safety knife 1.

Figure 1:
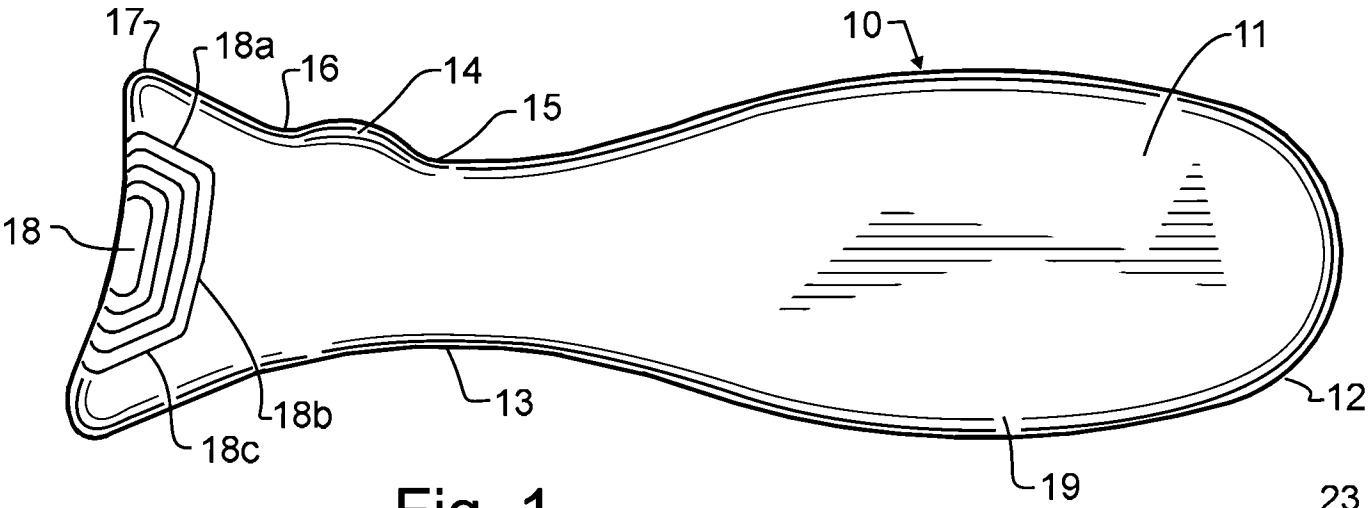
FIG. 1 illustrates a preferred embodiment sanitary knife handle designed in accord with the teachings of the present invention from a top plan view.

FIG. 1 illustrates a preferred embodiment handle 10 that forms the primary body of safety knife 1. As illustrated therein, a smooth and contoured palm portion 11 is defined by a pair of spaced apart, generally parallel, and generally planar major surfaces designed to be cradled comfortably and conveniently within the palm of a hand. Rounded end 12 facilitates this cradling by most preferably fitting within the oblique arch between the thumb and little finger, roughly between the abductor pollicis brevis muscle of the thumb and the abductor digiti minimi muscle of the little finger. This ensures that rounded end 12 will nestle with the edge pressing comfortably and yet securely into the palm of the hand.

A slightly narrower neck region 13 is adapted to be grasped by a person's fingers, in particular the middle and ring fingers. A small bump or protrusion 14 is provided that is configured to fit comfortably between the middle finger and index finger, with the middle finger resting in the narrowest part 15 of neck 13, and the index finger resting within a local narrow portion 16. Handle 10 flares outward from narrow portion 16 to terminate at flare 17.

Figure 4:
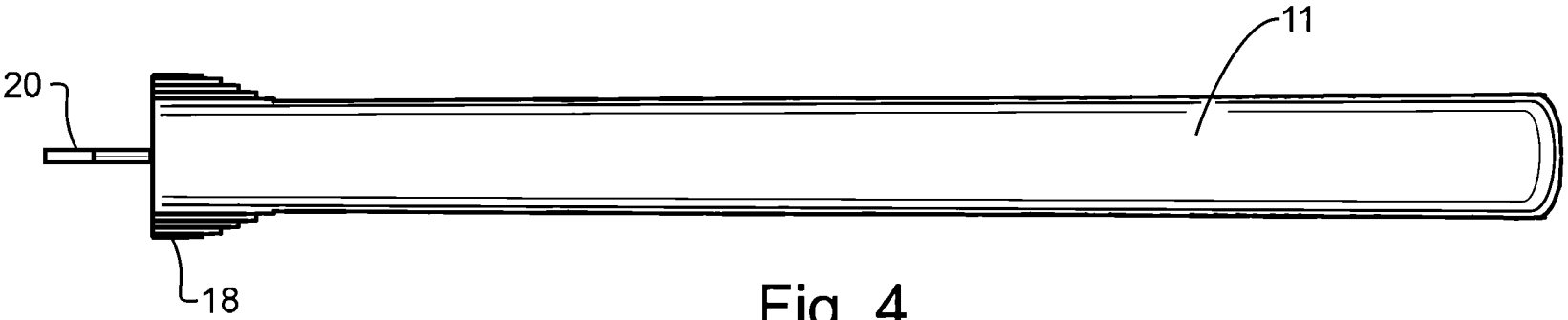
FIG. 4 illustrates the preferred embodiment safety knife of FIG. 3 from a side view.

The majority of handle 10 is relatively flat as may be viewed in FIG. 4, defining two opposed parallel major surfaces, but with slightly rounded edges 19 to provide greater comfort when being grasped. These major surfaces defined by opposed sides of palm portion 11 are in the preferred embodiment relatively flat except adjacent to the edges. As a result, a person's palm will wrap about the edge and readily apply force to either or both surfaces to better control rotation about the longitudinal axis. The generally planar major surfaces thereby assist with stability during handling, even when a person's hands are slippery. Nevertheless, it will be understood that in alternative embodiments these major surfaces may instead be domed or rounded in any suitable way. The spacing between the generally planar major surfaces defines a thickness, and an axis perpendicular to the longitudinal axis and the thickness defines the width of palm portion 11. Rounded end 12 defines one longitudinal termination of the enlarged palm portion 11, and is radiused about an axis perpendicular to the generally planar major surfaces.

The generally planar major surfaces defined by opposed faces ofpalm portion 11 extend from one longitudinal end of handle 10 nearly to the other longitudinal end. However, adjacent to flare 17 there is provided a stepped region 18 which gets progressively thicker than palm portion 11 and neck 13. As visible in FIG. 3, stepped region 18 is thickest most nearly adjacent to blade 20, and thereby provides a thumb stop that is adapted to help keep a person's thumb from sliding off of handle 10 toward blade 20. Particular in the case of the food industry, but for many other applications as well, a person using the safety knife may not always have clean hands. This is particularly the case for a worker who opens packages with wet contents. In such instance, the features of the stepped region 18 provide the desired degree of gripping ability and stability within a person's hand, while still retaining desirable cleaning in an automatic dishwasher or the like.

Even in the event a person's hand does slide off of handle 10 toward blade 20, there is most preferably sufficient offset between the highest point of stepped region 18 and blade 20 that the person's hand will in most circumstances still not come into contact with blade 20. The amount of offset will be determined by a designer and may be varied for different industries and applications, but will preferably provide adequate time for a person to stop squeezing before contacting blade 20, or, in the alternative, to not only slide off of handle 10 but also past blade 20 before their pinching grasp contracts sufficiently that it would otherwise contact blade 20.

Because different persons may grasp handle 10 differently, and because they may also grasp handle 10 differently for a particular task, each step within stepped region 18 is provided with three generally linear segments 18*a*, 18*b*, and 18*c*, each angularly offset from the other. This allows a person to user their thumb to press against stepped region 18 from three different directions, while still gaining optimal traction therewith.

Figure 2:
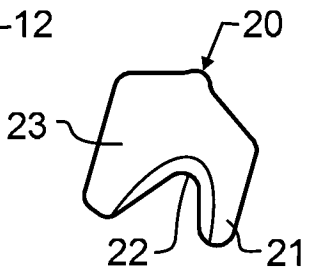
FIG. 2 illustrates a preferred embodiment sanitary knife blade designed in accord with the teachings of the present invention from a top view.

FIG. 2 illustrates preferred embodiment knife blade 20 in greater detail and separate from handle 10. Knife blade 20 has a rounded tip 21, a ground cutting edge 22, and an anchoring region 23. Most preferably, cutting edge 22 forms a "V" or "U" shaped opening that is sufficiently narrow to not permit a person's finger to enter into and contact cutting edge 22. Likewise, the outer perimeter of knife blade 20, including rounded tip 21, is sufficiently wide and blunted to not present any real hazard to a person's hand. The particular geometry of anchoring region 23 is not critical to the present invention, an so may take on any suitable form that facilitates knife blade 20 being securely affixed within handle 10. Consequently, anchoring region 23 may be much larger than illustrated, and may further have holes or the like formed through the thickness of knife blade 20, to assist with secure anchoring into handle 10.

Figure 3:
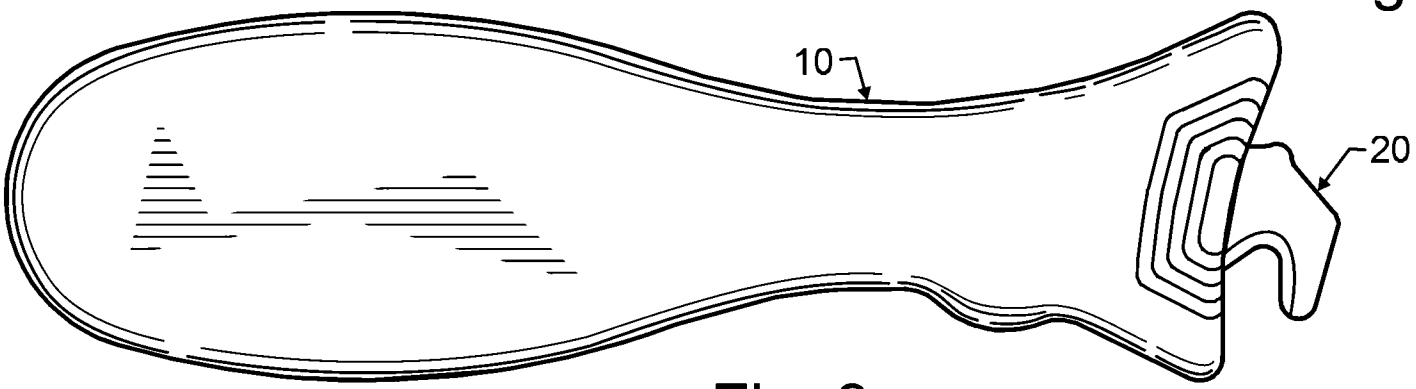
FIG. 3 illustrates the preferred embodiment sanitary knife handle of FIG. 1 in further combination with the preferred embodiment sanitary knife blade of FIG. 2, the combination sanitary knife designed in accord with the teachings of the present invention from a top plan view.

FIG. 3 illustrates preferred embodiment safety knife 1 fully assembled, incorporating both handle 10 and knife blade 20. The particular technique to anchor knife blade 20 into handle 10 is also not critical to the present invention. In the case of preferred embodiment safety knife 1, handle 10 is preferably formed around knife blade 20, such as by injection or other plastic molding technique. As apparent from the Figure, knife blade 20 does not extend radially beyond flare 17 and instead is preferably radially recessed slightly therefrom. Consequently, flare 17 operates in a manner similar to stepped region 18, and may, if so desired in alternative embodiments, be provided with similar discrete steps.

Figure 5:
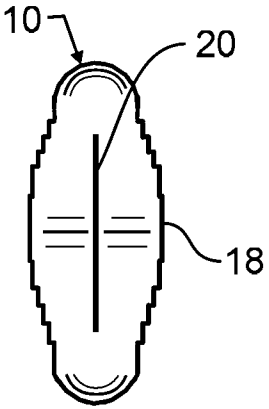
FIG. 5 illustrates the preferred embodiment safety knife of FIG. 3 from an end view.

FIG. 4 illustrates the preferred embodiment safety knife 1 from a side view, while FIG. 5 illustrates the preferred embodiment safety knife 1 from an end view. Each of these views show in particular the stepped region 18. Steps are preferred, since the sharp edges or discontinuities created at the junction between riser and tread provide improved grasping, while retaining the ability to be completely cleaned using equipment such as an automatic dishwasher. Further, these steps do not create any areas that could entrap food particles or liquids.

In use, a person will grasp safety knife 1 by placing their thumb with their thumb print pressed against the major surface visible in FIGS. 1 and 3, immediately adjacent to and preferably in contact with steps 18. Their index finger will slip into local narrow portion 16, with the joint between distal phalange and intermediate phalange close to or wrapping around the edge of handle 10. Likewise, some combination of the index finger intermediate phalange and proximal phalange will preferably butt against stepped region 18 on the major face of handle 10 opposite to the major face where the thumb print contacts the stepped region 18. When viewed from the end view of FIG. 5, the person's index finger will form a U-shape wrapping around both edges and one side of stepped region 18, while the person's thumb will contact the other side of stepped region 18. Owing to flare 17, when a person squeezes their index finger, the index finger will tend to slide away from blade 20 and toward palm portion 11 of handle 10. Of course, protrusion 14 will limit this movement. Consequently, both the person's thumb and index finger will work cooperatively to keep the person's hand from sliding into contact with knife blade 20.

Should the person's hand still inadvertently slide off of handle 10 and into the vicinity of knife blade 20, the combination of flare 17 and stepped region 18 will still create a substantial gap in the radial direction relative to knife blade 20. This radial gap is sufficient to give the person adequate time to release and re-grip safety knife 1 without ever contacting knife blade 20.

Most preferably, the material for knife blade 20 is a metal that may be readily detected using common metal detectors known in the food preparation industry. Handle 10 is preferably fabricated from a food grade plastic, and as noted herein above is explicitly designed to not have any fine grooves, undesirable porosity, or pockets that might entrap food particles or liquids. The resulting preferred embodiment safety knife 1 is sanitary, light weight, comfortable to use, easy to control, and, perhaps most importantly, extremely safe to use.

In accord with a preferred method of processing food, there are provided at least two collections of preferred embodiment safety knives 1. A first collection comprises handles 10 of a first color, for exemplary and non-limiting purposes fabricated with a red material. A second collection comprises handles 10 of a second color different from the first color. For exemplary and non-limiting purposes, the second color is blue. The first color, red in the example, is preferably used in the processing of raw meats. The second color, blue in the example, is exclusively used in the processing areas that only handle ready-to-eat food. By providing at least two distinct handle colors, the chances of contamination of the ready-to-eat food is decreased.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A food grade safety knife, comprising:

a safety knife blade; and a handle defined by a pair of spaced apart, generally parallel, and generally planar major surfaces having:

an enlarged palm portion distal to said safety knife blade;

a flared end distal to said enlarged palm portion, said safety knife blade extending from said handle flared end in a direction distal to said enlarged palm portion;

a neck region intermediate between and relatively narrower than said enlarged palm portion and said flared end;

a longitudinal axis terminating adjacent to said safety knife blade; and a stepped region within said flared end and immediately adjacent to said safety knife blade, said stepped region of thickness greater than said enlarged palm portion and having a plurality of discrete steps rising from said generally planar major surfaces to a greatest thickness most adjacent to said safety knife blade;

individual ones of said plurality of discrete steps having a step edge geometry defined by a first linear segment extending along an axis transverse to and crossing said handle longitudinal axis and having a first termination and a second termination distal to said first termination, a second linear segment extending from said first linear segment first termination at an angle intermediate between the axis along which the first linear segment extends and said handle longitudinal axis and increasing in distance from said handle longitudinal axis with an increase in distance from said first linear segment first termination, and a third linear segment extending from said first linear segment second termination at an angle intermediate between the axis along which the first linear segment extends and said handle longitudinal axis and increasing in distance from said handle longitudinal axis with an increase in distance from said first linear segment second termination, both said second and third linear segments increasing in distance from said enlarged palm portion with an increase in distance from said first linear segment.

2. The food grade safety knife of claim 1, wherein said stepped region generally increases in thickness with increasing distance from said enlarged palm portion to a maximum thickness most nearly adjacent to said safety knife blade, wherein said stepped region is thereby adapted to resist a person's thumb sliding off of said handle toward said safety knife blade.

3. The food grade safety knife of claim 2, wherein an offset is provided between said stepped region most nearly adjacent to said safety knife blade and said safety knife blade, and wherein the offset is adapted to provide adequate time for a person to stop squeezing before contacting said safety knife blade.

4. The food grade safety knife of claim 1, further comprising a protrusion extending from and thereby locally widening said neck region.

5. The food grade safety knife of claim 1, wherein said enlarged palm portion further comprises a rounded edge terminating said enlarged palm portion most distally to said flared end, said rounded edge radiused about an axis perpendicular to said generally planar major surfaces.

6. The food grade safety knife of claim 1, wherein said safety knife blade further comprises:

a rounded and blunt tip terminating said safety knife blade longitudinally distal to said enlarged palm portion;

an anchoring region captured within said handle flared end; and a cutting edge intermediate between said rounded tip and said anchoring region.

7. The food grade safety knife of claim 6, wherein said cutting edge further comprises a concave "U" shape having a small radius adapted to block a human finger from entering into contact therewith.

8. The food grade safety knife of claim 1, wherein said handle further comprises a food grade composition.

9. The food grade safety knife of claim 8, wherein said handle further comprises a first color indicative of contact with raw food.

10. A food grade safety knife, comprising:

a safety knife blade having:

a rounded tip terminating said safety knife blade at a first end;

an anchoring region terminating said safety knife blade at a second end distal to said first end; and a cutting edge intermediate between said rounded tip and said anchoring region;

a handle defined by a pair of spaced apart, generally parallel, and generally planar major surfaces having:

an enlarged palm portion distal to said safety knife blade;

a flared end distal to said enlarged palm portion, said safety knife blade anchoring region captured within said handle flared end and said safety knife blade extending from said handle flared end in a direction distal to said enlarged palm portion;

a neck region intermediate between and relatively narrower than said enlarged palm portion and said flared end;

a longitudinal axis terminating adjacent to said safety knife blade; and a stepped region within said flared end and immediately adjacent to said safety knife blade, said stepped region of thickness greater than said enlarged palm portion and thereby rising in a plurality of discrete steps from said generally planar major surfaces and generally increasing in thickness with increasing distance from said enlarged palm portion to a maximum thickness most nearly adjacent to said safety knife blade, at least one of said plurality of steps within said stepped region provided with a first linear segment extending along an axis transverse to and crossing said handle longitudinal axis and having a first termination and a second termination distal to said first termination, a second linear segment extending from said first linear segment first termination at an angle intermediate between the axis along which the first linear segment extends and said handle longitudinal axis and increasing in distance from said handle longitudinal axis with an increase in distance from said first linear segment first termination, and a third linear segment extending from said first linear segment second termination at an angle intermediate between the axis along which the first linear segment extends and said handle longitudinal axis and increasing in distance from said handle longitudinal axis with an increase in distance from said first linear segment second termination, both said second and third linear segments increasing in distance from said enlarged palm portion with an increase in distance from said first linear segment.

11. The food grade safety knife of claim 10, wherein an offset is provided between said stepped region most nearly adjacent to said safety knife blade and said safety knife blade, and wherein the offset is adapted to provide adequate time for a person to stop squeezing before contacting said safety knife blade.

12. The food grade safety knife of claim 10, further comprising a protrusion extending from and thereby locally widening said neck region.

13. The food grade safety knife of claim 10, wherein said enlarged palm portion further comprises a rounded edge terminating said enlarged palm portion most distally to said flared end, said rounded edge radiused about an axis perpendicular to said generally planar major surfaces.

14. The food grade safety knife of claim 10, wherein said cutting edge further comprises a concave "U" shape having a small radius adapted to block a human finger from entering into contact therewith.

15. The food grade safety knife of claim 10, wherein said handle further comprises a food grade composition.

16. The food grade safety knife of claim 15, wherein said handle further comprises a first color indicative of contact with raw food.

17. A food grade safety knife, comprising:

a safety knife blade;

a handle defined by a pair of spaced apart, generally parallel, and generally planar major surfaces having:

an enlarged palm portion distal to said safety knife blade;

a flared end terminating said handle distal to said enlarged palm portion, said flared end perpendicular to and spanning between said pair of spaced apart, generally parallel, and generally planar major surfaces, said safety knife blade protruding and extending directly from said handle flared end in a direction from said flared end opposite from said enlarged palm portion;

a neck region intermediate between and relatively narrower than said enlarged palm portion and said flared end;

a longitudinal axis terminating adjacent to said safety knife blade; and a stepped region within said flared end and immediately adjacent to said safety knife blade, said stepped region of thickness greater than said enlarged palm portion and having a plurality of discrete steps rising from said generally planar major surfaces to a greatest thickness most adjacent to said safety knife blade;

individual ones of said plurality of discrete steps having a step edge geometry defined by a first linear segment extending along an axis transverse to and crossing said handle longitudinal axis and having a first termination and a second termination distal to said first termination, a second linear segment extending away from said first linear segment first termination at an angle intermediate between the axis along which the first linear segment extends and said handle longitudinal axis and increasing in distance from said handle longitudinal axis with an increase in distance from said first linear segment first termination, and a third linear segment distal to said second linear segment and extending from said first linear segment second termination at an angle intermediate between the axis along which the first linear segment extends and said handle longitudinal axis and increasing in distance from said handle longitudinal axis with an increase in distance from said first linear segment second termination, both said second and third linear segments increasing in distance from said enlarged palm portion with an increase in distance from said first linear segment, said first, second, and third linear segments providing a thumb stop configured to resist a person's thumb sliding off of said handle in a direction toward said safety knife blade.

* * * * *